United States Patent [19]

Chang

[11] Patent Number: 4,962,925

[45] Date of Patent: Oct. 16, 1990

[54] EXERCISE BICYCLE

[76] Inventor: Chester Chang, No. 1-5, Chun Ting Hsiang, Ya Tan Rd., San Ho Tsun, Ta Ya Hsiang, Taichung Hsien, Taiwan

[21] Appl. No.: 377,312

[22] Filed: Jul. 10, 1989

[51] Int. Cl.[5] ..... A63B 21/00

[52] U.S. Cl. ..... 272/73

[58] Field of Search ..... 272/73, DIG. 2, 71, 272/72, DIG. 6, 132

[56] References Cited

U.S. PATENT DOCUMENTS

| | | | |
|---|---|---|---|
| 4,188,030 | 2/1980 | Hooper | 272/70 |
| 4,657,244 | 4/1987 | Ross | 272/73 |
| 4,660,826 | 4/1987 | Lee | 272/73 |
| 4,664,400 | 5/1987 | Date | 272/73 |
| 4,842,268 | 6/1989 | Jenkins | 272/73 |

FOREIGN PATENT DOCUMENTS

| | | | |
|---|---|---|---|
| 0517774 | 2/1931 | Fed. Rep. of Germany | 272/73 |

*Primary Examiner*—Stephen R. Crow

*Attorney, Agent, or Firm*—Rogers, Howell & Haferkamp

[57] ABSTRACT

An exercise bicycle includes a frame body having a seat and a pair of handles. A vane wheel is rotatably supported on a rear end of the frame body. A multi-axial crank is pivotally supported on the frame body. A lower end of each handle is coupled to one of two crank axles of the multi-axial crank. A rotation of the multi-axial crank makes a back and forth movement of the lower ends of the handles, and the back and forth movement of the lower ends of the handles makes a rotation of the multi-axial crank.

1 Claim, 4 Drawing Sheets

EXERCISE BICYCLE

FIELD OF THE INVENTION

The present invention relates to an exercising mechanism, and more particularly to an exercise cycle.

BACKGROUND OF THE INVENTION

A conventional exercise bicycle is shown in FIG. 4. The exercise bicycle comprises generally a frame body A with a seat B and a pair of handles C. A vane wheel E is driven by a pair of foot pedals F via two sets of a chain and a sprocket D. The handles C are coupled to the pedals F by a pair of crank rings G and a pair of connecting links H.

This is complicated and time consuming to manufacture, and consequently the cost is relatively high. A feeling of uneven riding occurs due to the eccentric crank ring G. Therefore, a simplified exercise bicycle with a low maintenance cost is desired.

The present invention has arisen to mitigate and/or obviate the afore-described disadvantages of the conventional exercise bicycle.

SUUMARY OF THE INVENTION

The primary objective of the present invention is to provide an exercise bicycle, the structure of which is simplified and the operation of which is reliable.

The present invention provides an exercise bicycle including a frame body having a seat and a pair of handles. A vane wheel is rotatably supported on a rear end of the frame body. A multi-axial crank is pivotally supported on the frame body. A lower end of each handle is coupled to one of two crank axles of the multi-axial crank. A rotation of the multi-axial crank makes a back and forth movement of the lower ends of the handles, and the back and forth movement of the lower ends of the handles makes a rotation of the multi-axial crank.

Further objective and advantages of the present invention will become apparent from a careful reading of the detailed description provided hereinafter, with appropriate reference to the accompanying drawings.

DETAILED DESCRIPTION OF THE INVENTION

Figure 1:
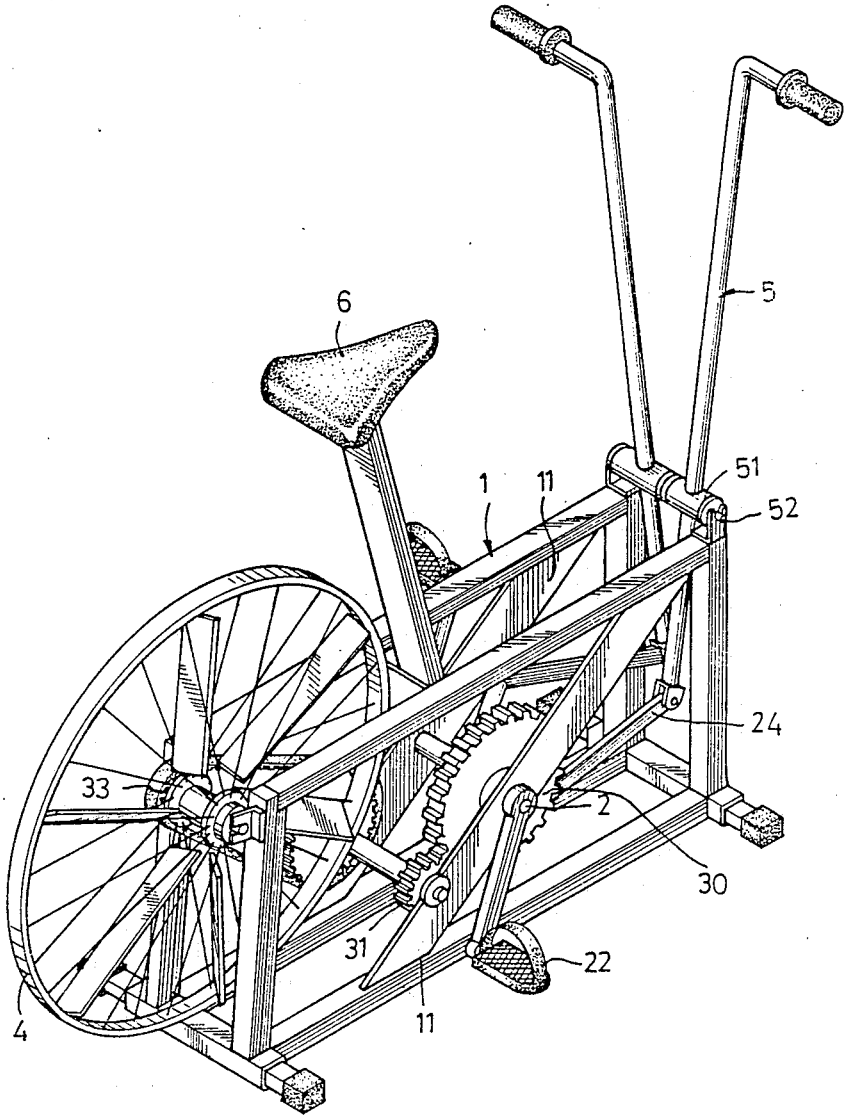
FIG. 1 is a perspective view of an exercise bicycle in accordance with the present invention.

Referring to the drawings and initially to FIG. 1, the exercise bicycle in accordance with the present invention comprises generally a frame body 1 having a pair of handles 5 and a seat 6, a gear transmission 3 and a vane wheel 4 being rotatably attached to a rear end of the frame body 1.

The frame body 1 is generally a box shaped frame with a pair of cross bars 11 so as to construct the frame body 1 rigidly and give a solid and stable exercise bicycle.

Figure 2:
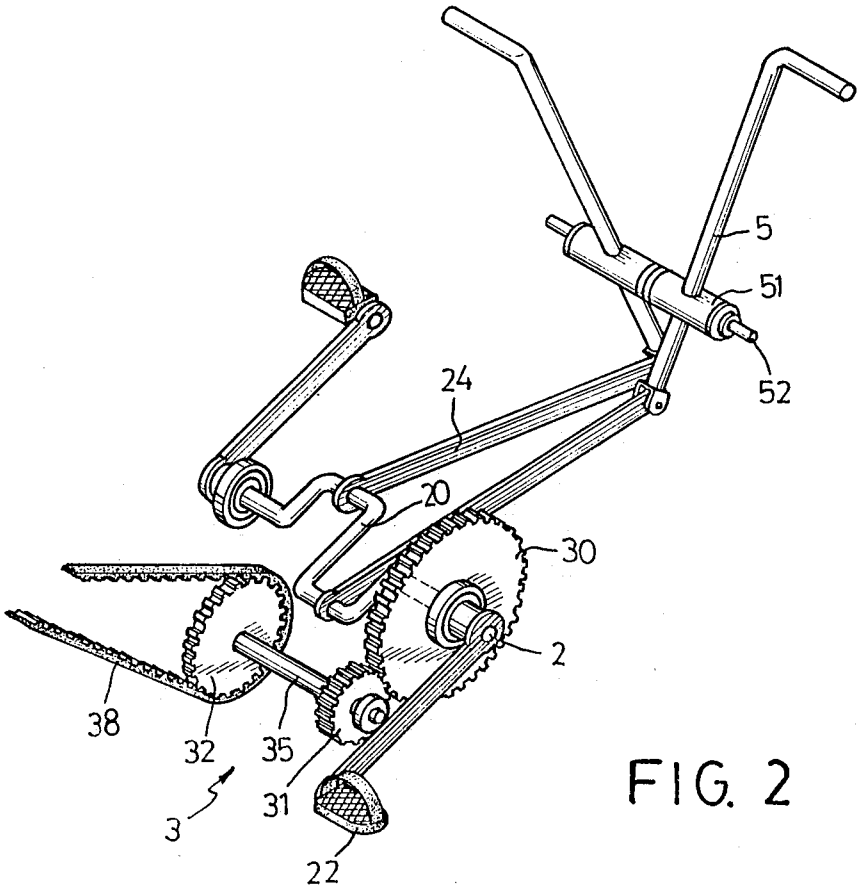
FIG. 2 is a partial perspective view showing the transmission assembly of the exercise bicycle as shown in FIG. 1.

Referring to FIGS. 1 and 2, a multi-axial crank 20 which has two crank arms is pivotally supported on the cross bars 11 of the frame body 1. A first driving gear 30 is fixed on a rotatable driving axle 2, which is a main crank shaft of the multi-axial crank 20. A first pinion 31 and a second gear 32 of a gear set 3 are fixed on a couple axle 35 and are moved concurrently. The first pinion 31 engages the first driving gear 30 and is driven thereby. A second pinion 33 is provided on an axle of the vane wheel 4 and a belt 38 is coupled between the second gear 32 and the second pinion 33.

A pedal 22 is fixed to a free end of each crank arm of the multi-axail crank 20 via a rod. The driving axle 2 of the multi-axial crank 20 is actuated to rotate by the foot pedals 22. The lower ends of the handles 5 are coupled to the respective crank axles of the multi-axial crank 20 by a pair of connecting links 24 such that the rotation of the multi-axial crank 20 about the driving axle 2 thereof makes the lower ends of the handles 5 move back and forth, and in turn makes the handles 5 swing. Each handle 5 is disposed on a rotatable block 51 which is in turn rotatably provided on a supporting axle 52 in order that the handles 5 swing about the supporting axle 52 which is supported on a front end of the frame body 1.

Figure 3:
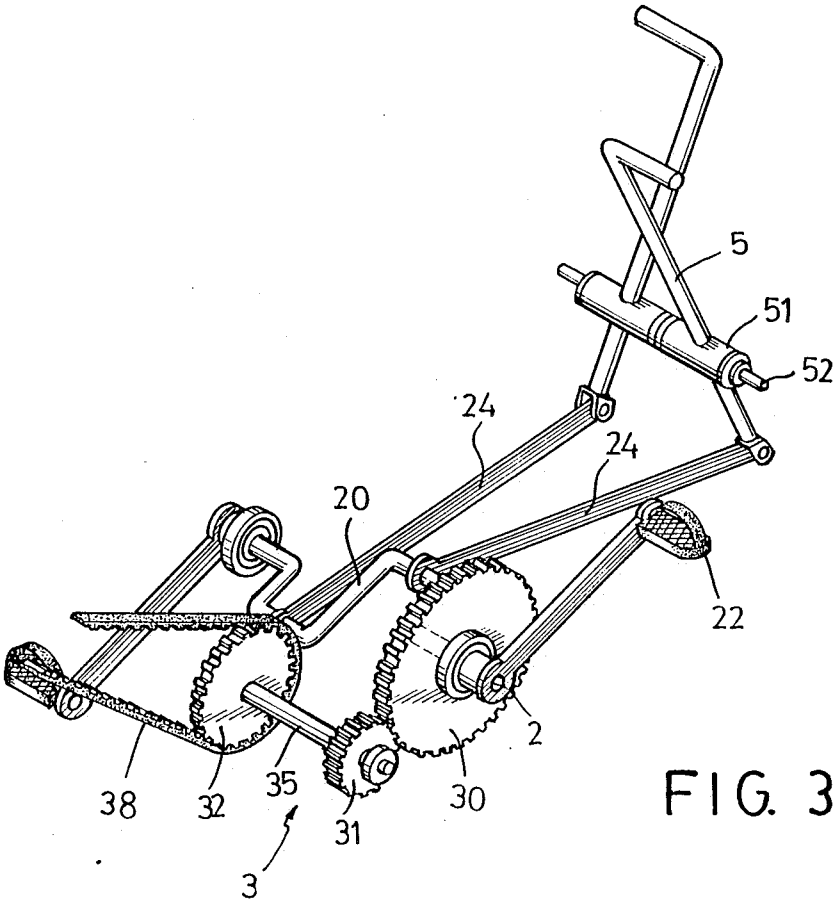
FIG. 3 is a partial perspective view similar to FIG. 2, showing another relative position of the transmission assembly of the exercise bicycle.
Figure 4:
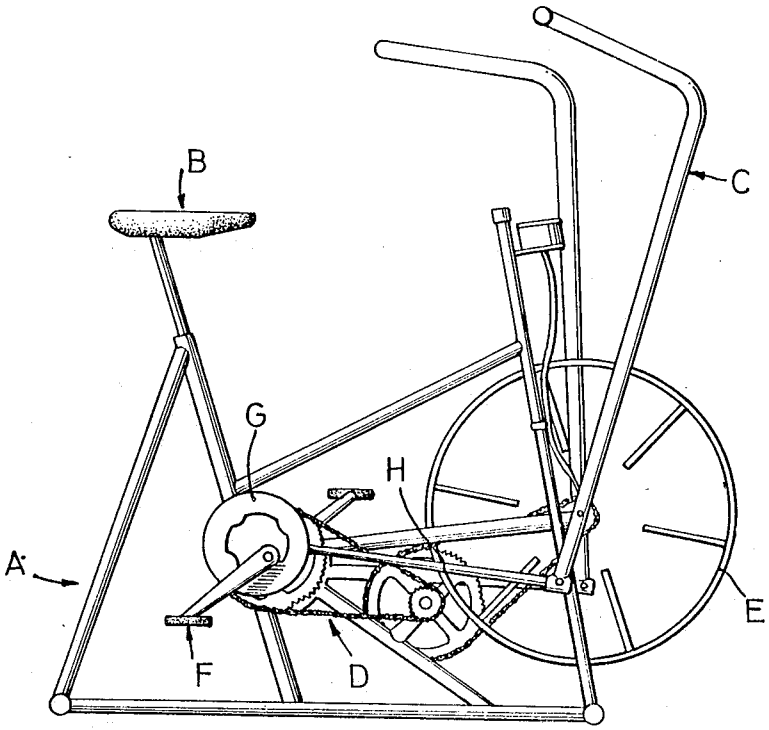
FIG. 4 PRIOR ART
FIG. 4 is a plane view of a conventional exercise bicycle.

Referring next to FIGS. 1, 2 and 3, the wheel 4 is either driven by a rotation of the multi-axial crank 20 about the driving axle 2 or driven by a back and forth movement of the lower ends of the handles 5. When pulling and pushing the upper ends of the handles 5, the back and forth motion of the lower ends of the handles 5 drives and rotates the multi-axial crank 20 via the connecting links 24 such that a user can operate the exercise bicycle either with the arms or the feet.

Since both ends of the driving axle of the multi-axial crank are supported on the cross bars 11 of the frame body 1, a stable and rigid exercise bicycle is obtained. In addition, the balanced rotation of the multi-axial crank 20 gives people an excellent exercise bicycle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise bicycle comprising a frame body having a seat and a pair of handles, said frame body being generally a box shaped frame; a wheel being rotatably provided on said frame body; a middle portion of each said handle being pivoted on a front portion of said frame body; a multi-axial crank which has two crank arms being provided on said frame body; a lower end of each said handle being coupled to a respective crank axle of said multi-axial crank via a connecting link; a pedal being coupled to a free end of each said crank arm; and a gear transmission being coupled between said multi-axial crank and said wheel, said wheel transmission including a first driving gear fixed to a main crank axle of said multi-axial crank, a first pinion being engaged with said first driving gear and driven thereby, a second driving gear being coaxial with said first pinion and driven thereby, and a belt being coupled between said second driving gear and a second pinion which is fixed on an axle of said wheel such that said wheel is drivable either by a rotation of said multi-axial crank or by a back and forth movement of said lower ends of said handles.

* * * * *